US010883282B2

(12) United States Patent
Larson

(10) Patent No.: US 10,883,282 B2
(45) Date of Patent: Jan. 5, 2021

(54) ANCHORING DEVICE AND METHOD FOR INSTALLATION

(71) Applicant: Platformer Solutions Ltd., Calgary (CA)

(72) Inventor: Terry Shane Larson, Okotoks (CA)

(73) Assignee: PLATFORMER SOLUTIONS LTD., Calgary (CA)

( * ) Notice: Subject to any disclaimer, the term of this patent is extended or adjusted under 35 U.S.C. 154(b) by 0 days.

(21) Appl. No.: 15/527,133

(22) PCT Filed: Nov. 17, 2015

(86) PCT No.: PCT/CA2015/051196

§ 371 (c)(1),
(2) Date: May 16, 2017

(87) PCT Pub. No.: WO2016/077919

PCT Pub. Date: May 26, 2016

(65) Prior Publication Data

US 2017/0356199 A1 Dec. 14, 2017

Related U.S. Application Data

(60) Provisional application No. 62/080,915, filed on Nov. 17, 2014.

(51) Int. Cl.
*E04G 5/04* (2006.01)
*E04G 3/24* (2006.01)
(Continued)

(52) U.S. Cl.
CPC ..... *E04G 5/046* (2013.01); *E04G 1/15* (2013.01); *E04G 3/246* (2013.01); *E06C 7/086* (2013.01);
(Continued)

(58) Field of Classification Search
CPC .... E04G 5/046; E04G 3/246; E04G 2001/157
See application file for complete search history.

(56) References Cited

U.S. PATENT DOCUMENTS 984,993 A * 2/1911 Anderson ..... E04G 11/22 425/63
1,623,892 A * 4/1927 Sobray ..... E04G 5/046 248/220.21
(Continued)

FOREIGN PATENT DOCUMENTS

EP 0606948 A1 * 7/1994 ..... E04G 5/041
EP 0606948 A1 * 10/1994
(Continued)

OTHER PUBLICATIONS

International Search Report dated Feb. 5, 2016 issued in PCT/CA2015/051196.
Written Opinion dated Feb. 5, 2016 issued in PCT/CA2015/051196.

*Primary Examiner* — Daniel P Cahn
*Assistant Examiner* — Candace L Bradford
(74) *Attorney, Agent, or Firm* — McCoy Russell LLP

(57) ABSTRACT

A system and method for creating an anchoring device that attaches between two nearby surfaces that may be oriented at different angles to each other about a vertical axis is described. The anchoring device includes a first and second support base that are fastened to a support surface, and a cross member that extends between the support bases and is pivotable about a vertical axis with respect to the support bases. The cross member may be adjustable in length. The anchoring device can be used to support an end of a plank to make a platform. The other end of the plank may be supported by a second anchoring device or another support surface.

18 Claims, 11 Drawing Sheets

(51) Int. Cl.

| | |
|---|---|
| ***E04G 1/15*** | (2006.01) |
| ***E06C 7/08*** | (2006.01) |
| ***E06C 9/04*** | (2006.01) |
| *E04G 1/36* | (2006.01) |

(52) U.S. Cl.
CPC ..... *E06C 9/04* (2013.01); *E04G 1/367* (2013.01); *E04G 2001/157* (2013.01)

(56) References Cited

U.S. PATENT DOCUMENTS

| | | | | | |
|---|---|---|---|---|---|
| 1,629,718 | A * | 5/1927 | Lockard | E04G 3/20 | 182/128 |
| 1,660,693 | A * | 2/1928 | Urmson | E04G 5/046 | 182/87 |
| 1,737,315 | A * | 11/1929 | MacDonald | E04G 1/151 | 403/393 |
| 1,757,015 | A * | 5/1930 | Kingston | E04G 5/046 | 403/376 |
| 2,172,796 | A * | 9/1939 | Krasin | E04G 5/046 | 52/27 |
| 2,447,865 | A * | 8/1948 | McClintock | E04G 1/151 | 182/223 |
| 2,834,527 | A * | 5/1958 | Aller | B65D 88/34 | 182/84 |
| 3,026,963 | A * | 3/1962 | Wilkie | E04G 5/04 | 182/93 |
| 3,183,855 | A * | 5/1965 | Adler | B61D 45/001 | 410/140 |
| 3,376,007 | A * | 4/1968 | Chesterley | A47F 7/0042 | 248/285.1 |
| 3,426,659 | A * | 2/1969 | Preston | E02D 17/10 | 404/25 |
| 4,187,929 | A * | 2/1980 | Cyr | E04G 1/15 | 182/129 |
| 4,676,536 | A * | 6/1987 | Arbic | E05C 19/004 | 248/354.1 |
| 4,720,069 | A * | 1/1988 | Bessinger | A47B 96/061 | 211/90.01 |
| 4,737,056 | A * | 4/1988 | Hunt | B60P 7/15 | 224/404 |
| 4,850,453 | A * | 7/1989 | St-Germain | E04B 1/4178 | 182/229 |
| 4,893,772 | A | 1/1990 | Scott | | |
| 4,979,769 | A * | 12/1990 | Salyer | E05C 19/004 | 292/338 |
| 4,995,323 | A * | 2/1991 | Kellems | A47B 96/00 | 108/157.13 |
| 5,697,742 | A * | 12/1997 | House | B60P 7/15 | 410/121 |
| D394,640 | S * | 5/1998 | Pestone | D12/414 | |
| 6,470,646 | B1 * | 10/2002 | Bryant | E04G 3/26 | 182/206 |
| 6,742,975 | B2 * | 6/2004 | Trine | B60P 7/15 | 410/151 |
| 2002/0084141 | A1 | 7/2002 | Thomas | | |
| 2006/0180392 | A1 | 8/2006 | Scharff | | |
| 2006/0213722 | A1 | 9/2006 | Cunningham | | |
| 2011/0284326 | A1 * | 11/2011 | Haritou | E04G 1/362 | 182/132 |

FOREIGN PATENT DOCUMENTS

| | | | | |
|---|---|---|---|---|
| JP | 3751708 | | 3/2006 | |
| JP | 2011168969 | | 9/2011 | |
| WO | 2005019564 | | 3/2005 | |
| WO | WO-2008031902 | A1 * | 3/2008 | E04G 21/3219 |

* cited by examiner

ANCHORING DEVICE AND METHOD FOR INSTALLATION

CROSS-REFERENCE TO RELATED APPLICATIONS

This application is a 35 U.S.C. § 371 national phase application of PCT Application No. PCT/CA2015/051196, filed Nov. 17, 2015, which claims priority to US Provisional Application No. 62/080,915, filed Nov. 17, 2014, each of which is incorporated herein by reference in its entirety.

FIELD OF THE INVENTION

The invention relates generally to anchoring devices to surfaces, and more specifically to a system and method for creating an anchoring device that attaches between two nearby surfaces that may be oriented at different angles.

BACKGROUND OF THE INVENTION

Construction workers and other laborers need to access a variety of spaces during a building project to complete various tasks, such as painting, installing drywall, wiring electrical systems, installing plumbing and ventilation systems, and more. It can be difficult to access certain areas in or around a building to complete such tasks, especially in high areas. Typically workers set up scaffolding systems and/or ladders to access high areas, however certain architectural features create areas that can be quite difficult and/or unsafe to access using conventional scaffolding systems and ladders. This is particularly true for high spaces that are narrow and/or irregular shaped, such as in turrets, towers, spiral and regular staircases and areas with vaulted ceilings. These spaces often have walls at various angles and/or rounded walls. In such cases, workers often use ladders, planks, scaffolding and/or a combination thereof to create make-shift platforms to access these areas.

Building a scaffolding system and/or make-shift platform to access irregular spaces is generally complicated and time-consuming, and thus costly. The resulting platform is often unsafe because it may use equipment in a manner that it was not intended for, and may be unstable and lack solid anchors. Ladders may be used at angles the ladders are not intended for, and workers may have to stretch from the ladder to reach certain areas, which can be quite unsafe. Furthermore, the equipment can take up a great deal of space in an area that may be small to begin with, making it difficult to maneuver and work in the space, furthering increasing the safety hazards associated with the system. This, along with increasing pressure from insurance companies and safety inspectors to provide a safer workplace, has resulted in a need for a safe, effective and efficient system for accessing hard-to-reach areas during building projects.

The prior art teaches several scaffolding and platform systems designed for construction use. U.S. Patent Publication No. 2002/0084141 teaches a hanging scaffolding unit that hangs from the wall frame of a building under construction and is particularly suited for use adjacent the corners of a building. U.S. Patent Publication No. 2006/0180392 discloses a scaffold platform support that clamps or attaches to a support structure, such as a vertical stud. U.S. Patent Publication No. 2006/0213722 teaches a safety parapet system for securing to the walls of building structures and that can be disposed on uneven ground. U.S. Pat. No. 6,470,646 teaches a roof scaffolding system.

The prior art also teaches devices for anchoring to walls for other uses, such as U.S. Pate. No. 4,893,772 which teaches a fitting for securing a wire storage product, such as a shelf, storage bin, shoe rack or the like, between surfaces that may be at irregular angles to one another. U.S. Pat. No. 3,376,007 teaches a holding device that can be mounted to a wall and has an articulating arm for holding large display pads for presentations.

There is a need for an anchoring system that can be used to set up a platform in a variety of hard-to-reach spaces that have walls at various angles to each another. There is a further need for an anchoring system that can be secured to open framed or closed walls. There is also a need for such system to be safe, simple, quick to set up and relatively inexpensive.

SUMMARY OF THE INVENTION

In accordance with the invention, there is provided a system and a method for creating an anchoring device that attaches between two nearby surfaces that may be oriented at different angles to one another. There is also provided a system and method for creating a platform using one or more anchoring devices.

In accordance with one aspect of the invention, there is provided an anchoring device for attachment to a first and second surface comprising a first and second support base for attachment to the first and second surface, respectively; and a cross member having a first and second end for pivotable attachment to the first and second support base, the cross member being adjustable in length; wherein each end of the cross member can independently pivot about a vertical axis with respect to the support bases for allowing the anchoring device to attach to first and second surfaces that are at different angles with respect to a vertical axis.

In one embodiment, the cross member comprises at least two sections arranged in telescoping relationship to selectively vary the length of the cross member.

In another embodiment, each support base comprises a laterally extending flange for supporting one of the ends of the cross member.

In yet another embodiment, the cross member ends are pivotably attached to the laterally extending flange using a shaft or pin inserted into a bore. The bore may be located in the end of the cross member, and the shaft or pin extends vertically from the laterally extending flange. Alternatively, the bore is located in the laterally extending flange, and the shaft extends vertically from the end of the cross member. Or, the bore is located in the laterally extending flange and in the cross member, and the shaft is a separate member.

In certain embodiments, the first and second support bases include a plurality of holes for receiving fastening devices for fastening the first and second support bases to the first and second surfaces. The first and second support base may include a pin extending from a rear planar surface for engagement with the first and second surfaces, respectively, for holding the support bases in place on the first and second surfaces while the support bases are being fastened to the first and second surfaces.

In one embodiment, the first and second surfaces are wall studs.

In another embodiment, the anchoring device further comprises a plank having a first plank end supported by the cross member for anchoring an end of a platform. The plank end may have a lip or hook for engagement with the cross member. The plank may be adjustable in length.

In another aspect of the invention, there is provided a method for creating an anchoring device comprising the steps of a) fastening a first support base to a first surface; fastening a second support base to a second surface; b) pivotably connecting a first end of a cross member to the first support base; c) pivotably connecting the second end of the cross member to the second support base; and d) adjusting the length of the cross member to fit the anchoring device between the first and second surfaces.

The method may further comprise in steps a) and b), tacking the first and second support base to the first and second surface, respectively, using a pin connected to the first and second support base to hold the first and second support base in place with respect to the first and second surface during fastening.

In one embodiment, the method further comprises the steps of e) engaging a first end of a plank with the cross member for supporting the plank end; and f) anchoring a second end of the plank to a second anchoring device or support surface to create a platform.

In another embodiment, the method further comprises the steps of f) repeating steps a) to e) to create a second anchoring device; g) engaging a first end of a plank with the cross member of the first anchoring device for supporting the plank first end; h) adjusting the length of the plank so that a second end of the plank reaches the cross member of the second anchoring device; and i) engaging the second end of the plank with the cross member of the second anchoring device to create a platform supported by the first and second anchoring device.

BRIEF DESCRIPTION OF THE DRAWINGS

Various objects, features and advantages of the invention will be apparent from the following description of particular embodiments of the invention, as illustrated in the accompanying drawings. The drawings are not necessarily to scale, emphasis instead being placed upon illustrating the principles of various embodiments of the invention. Similar reference numerals indicate similar components.

DETAILED DESCRIPTION OF THE INVENTION

Various aspects of the invention will now be described with reference to the figures. For the purposes of illustration, components depicted in the figures are not necessarily drawn to scale. Instead, emphasis is placed on highlighting the various contributions of the components to the functionality of various aspects of the invention. A number of possible alternative features are introduced during the course of this description. It is to be understood that, according to the knowledge and judgment of persons skilled in the art, such alternative features may be substituted in various combinations to arrive at different embodiments of the present invention.

Anchoring Device

Figure 1:
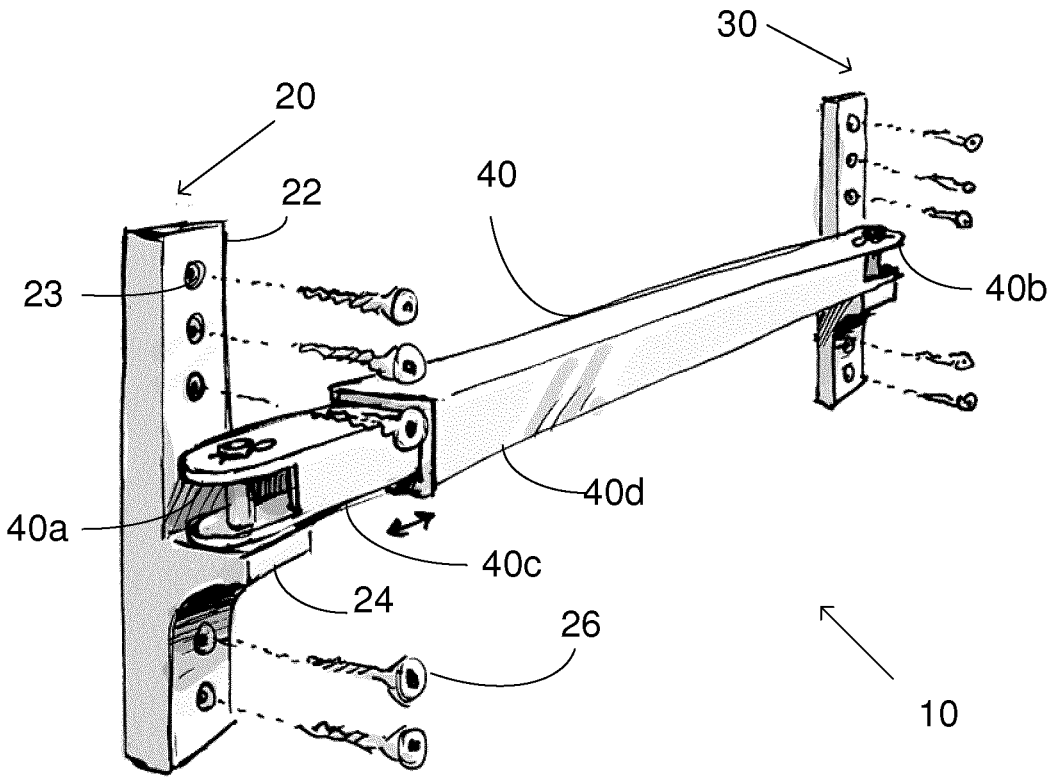
FIG. 1 is a front perspective view of an anchoring device.

Referring to FIG. 1, an anchoring device 10 is described. The anchoring device comprises a first and second support base 20, 30, and a cross member 40 that extends between the support bases.

Cross Member

Figure 4A:
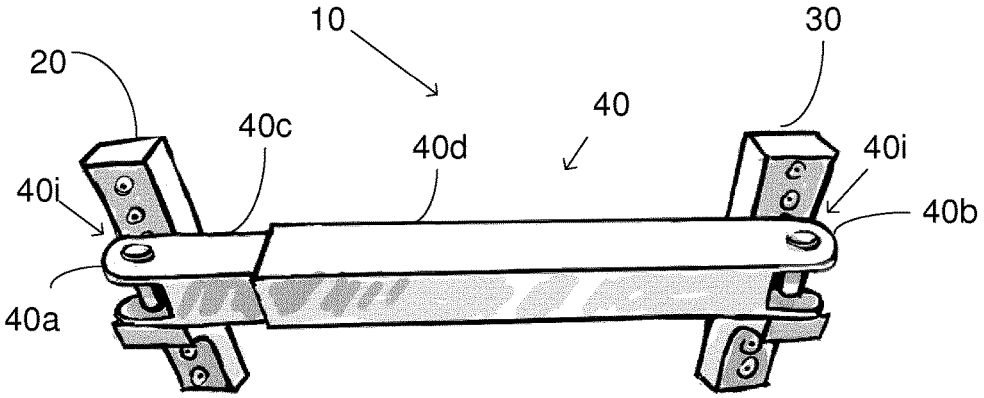
FIG. 4A is a top perspective view of the anchoring device of FIG. 1 illustrating the cross member in a retracted position.
Figure 4B:
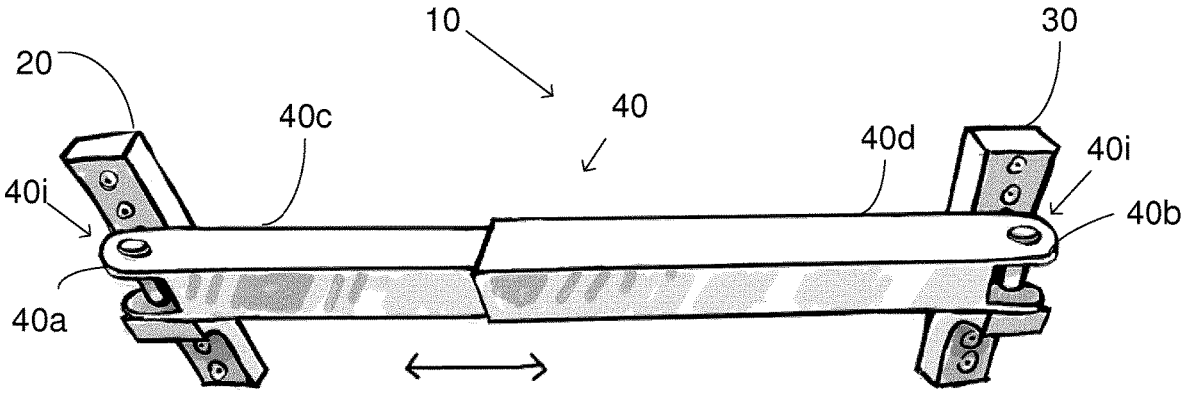
FIG. 4B is a top perspective view of the anchoring device of FIG. 1 illustrating the cross member in an expanded position.

The cross member 40 is comprised of two or more members 40*c*, 40*d* in telescopic engagement with each other such that the length of the cross member can be adjusted to accommodate various distances between the support bases 20, 30. FIG. 4A illustrates a cross member 40 in a contracted position to accommodate the support bases 20, 30 being located closer to each other, and FIG. 4B illustrates the cross member in an extended position to accommodate the support bases 20, 30 being located further away from each other. While the cross member is illustrated as comprising two members 40*c*, 40*d*, it is to be understood that there may be more than two members, such as for example, three members comprising a center member and two end members, the two end members telescopically moveable upon or within the center member. Alternatively, the cross member may be of fixed length, may comprise only one member, or may be adjustable in length using alternative means besides telescoping members.

First and second ends 40*a*, 40*b* of the cross member comprise connecting means for pivotable connection to the support bases 20, 30 such that each end of the cross member can pivot about a vertical axis with respect to the support base it is connected to, as described in more detail below.

Support Base

Figure 2:
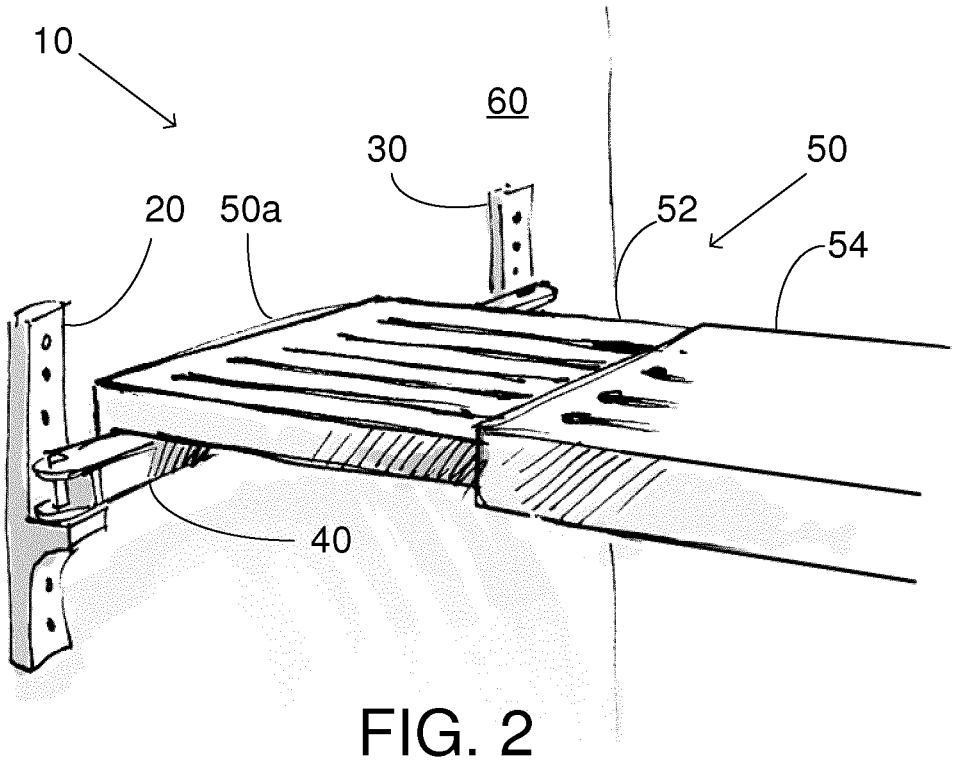
FIG. 2 is a front perspective view of an anchoring device supporting an end of a plank to create a platform.
Figure 7:
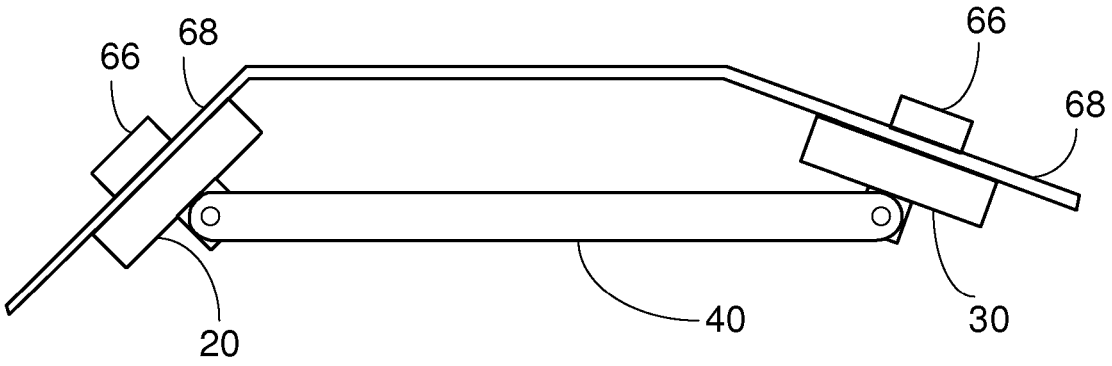
FIG. 7 is a top view of the anchoring device of FIG. 1 connected between two angled walls.

Referring to FIGS. 1 and 2, each support base 20, 30 is adapted for operative connection to a supporting member or surface 60, such as for example a wooden or metal wall stud, which may be either exposed or covered in drywall or another material. The supporting member/surface may also be a concrete wall or any other suitable support surface as would be known to those skilled in the art. FIG. 7 illustrates one embodiment wherein the support bases 20, 30 are fastened to studs 66 located behind drywall 68.

Figure 3A:
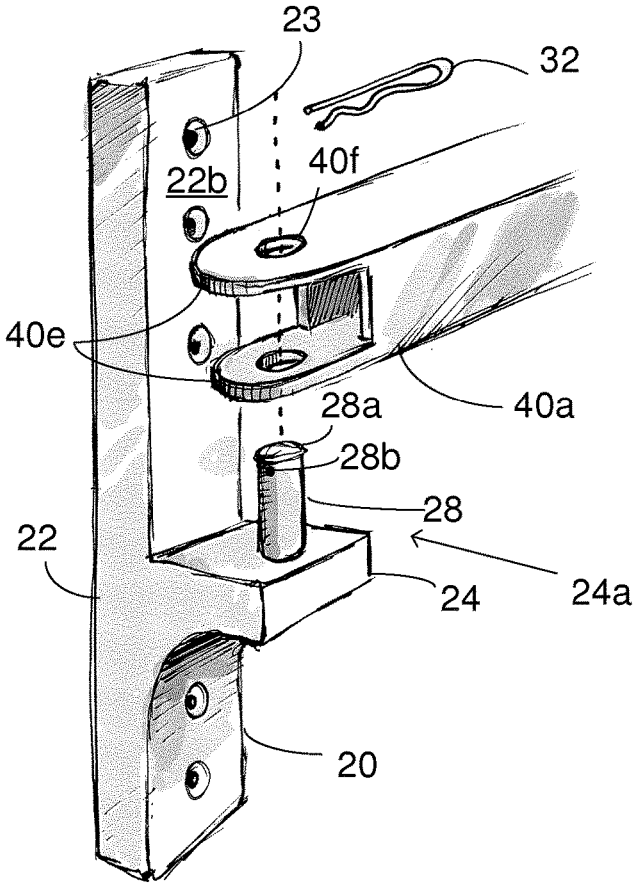
FIG. 3A is a front perspective exploded view of one end of the anchoring device of FIG. 1 illustrating the connection of the cross member to the support base using a clevis type fastener.
Figure 5A:
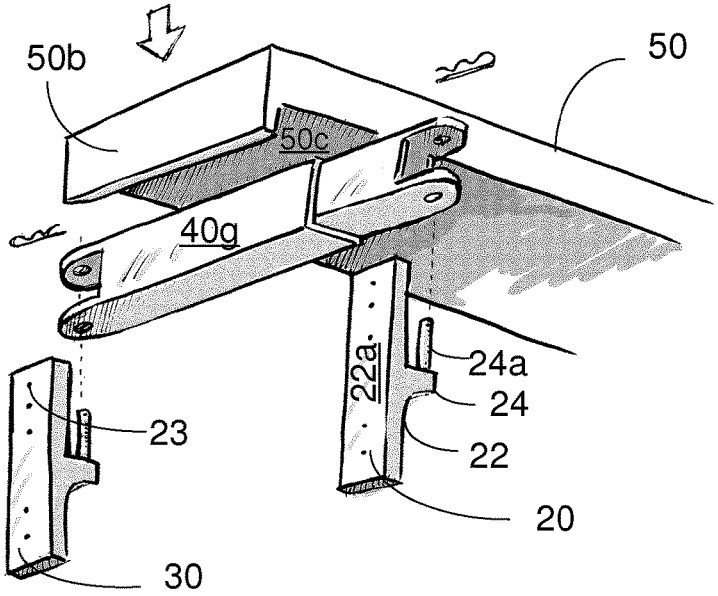
FIG. 5A is a bottom perspective exploded view of the anchoring device of FIG. 2 illustrating a plank with a lip being placed on the cross member to create a platform.

Referring to FIGS. 1, 3A and 5A, each support base 20, 30 comprises a body 22 having a rear planar face 22*a* for abutment with a support surface 60, and front planar face 22*b* from which a laterally extending flange 24 projects. The body 22 is fastened to the support surface using screws, nails, or other suitable fastening means 26. In the illustrated embodiment, the body includes a plurality of fastening holes 23 for retaining the fastening means. The laterally extending flange 24 supports one of the ends 40*a*, 40*b* of the cross member 40 and comprises attachment means 24*a* for pivotably connecting the cross member to the support base.

While the body 22 of the support base 20, 30 is illustrated as a linear rectangular shaped member having a plurality of fastening holes 23 in a vertical linear line, it is to be understood that the support base can be of different shapes and the fastening means arranged in a different manner. The shape of the support base and arrangement of the fastening means may be dependent on the surface to which it is designed to attach. For example, the support base body may include extensions from either side or end of the body and/or may have fastening holes staggered about a vertical axis.

Figure 20:
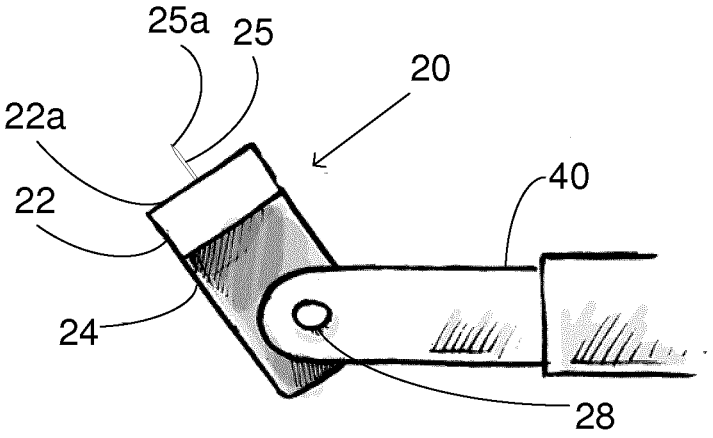
FIG. 20 is a side view of a support base of an anchoring device having a pin for engagement with a fastening surface.
Figure 21:
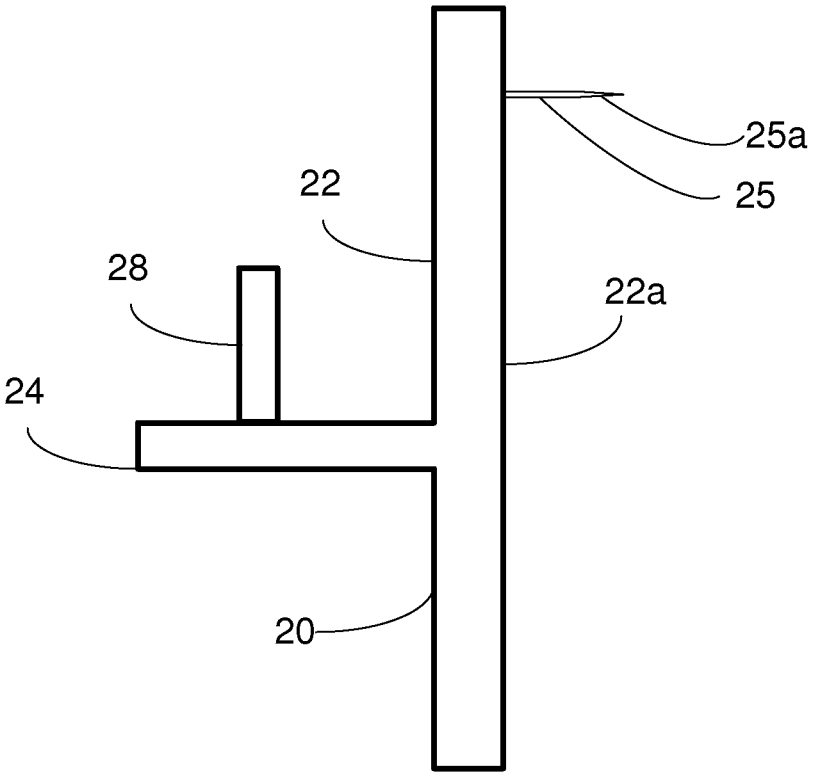
FIG. 21 is a top view of a support base of an anchoring device having a pin for engagement with a fastening surface.

The body 22 may also include a pin 25 extending from the rear planar surface 22*a*, preferably having a distal end 25*a* that is sharp or pointed, as shown in FIGS. 20 and 21 such that it can easily be driven into a supporting surface such as drywall and/or a wooden stud/beam. The pin allows the support base to be tacked to a supporting surface, preferably without the use of any tools, by simply striking the support base with the pin onto the supporting surface. If the supporting surface is relatively soft (e.g. drywall or wood), the pin will be at least partially driven into the supporting surface. This allows a user to then fasten the support base to the wall, e.g. using a screwdriver and screws, without having to hold the support base at the same time since the pin is securing the support base to the supporting surface. This is advantageous in that the user can attach the support base to the supporting surface using one hand, i.e. the user can strike or push the pin into the supporting surface using one hand which then holds the support base in place, allowing the user to release the support base to get a drill or screwdriver to then fasten the support base more securely in place. Additionally, the pin 25 may be used as a stud finder to find studs behind drywall to which the support base is to be fastened to. This embodiment is particularly useful when the anchoring device is anchored to wooden studs or beams, particularly studs or beams located behind drywall. The pin 25 is preferably a small gauge pin or nail that is easily driven through drywall and/or into a stud.

Pivotable Connection Attachment Means

FIG. 3A illustrates one suitable attachment means 24*a* for pivotably connecting the cross beam 40 to the support base 20. In this embodiment, a clevis-type fastener is used which comprises a shaft or pin 28 extending upwardly from the laterally extending flange 24 of the support base. The end 40*a* of the cross member comprises two prongs 40*e* having axially aligned holes or bores 40*f* through the prongs for receiving the pin 28. A top end 28*a* of the pin has a cross-hole 28*b* for receiving a split pin 32 which prevents the cross member from being disengaged from the support base pin/shaft 28.

In certain embodiments, the attachment means 24*a* may simply be a vertically/upwardly extending shaft or pin onto which the cross member is placed via a hole in the cross member, i.e. similar to the embodiment shown in FIG. 3A but without the split pin 32.

Figure 18:
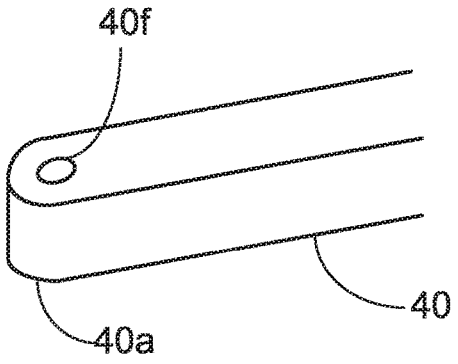
FIG. 18 is a front perspective view of a solid end of a cross member having a bore for engagement with a pin to pivotably connect the cross member to a support base.

Any number of prongs can be used at the end of the cross member for pivotable attachment to the support base. Alternatively, the cross member end 40*a* is solid with a single hole or bore 40*f* through the end, as shown in FIG. 18.

Figure 16:
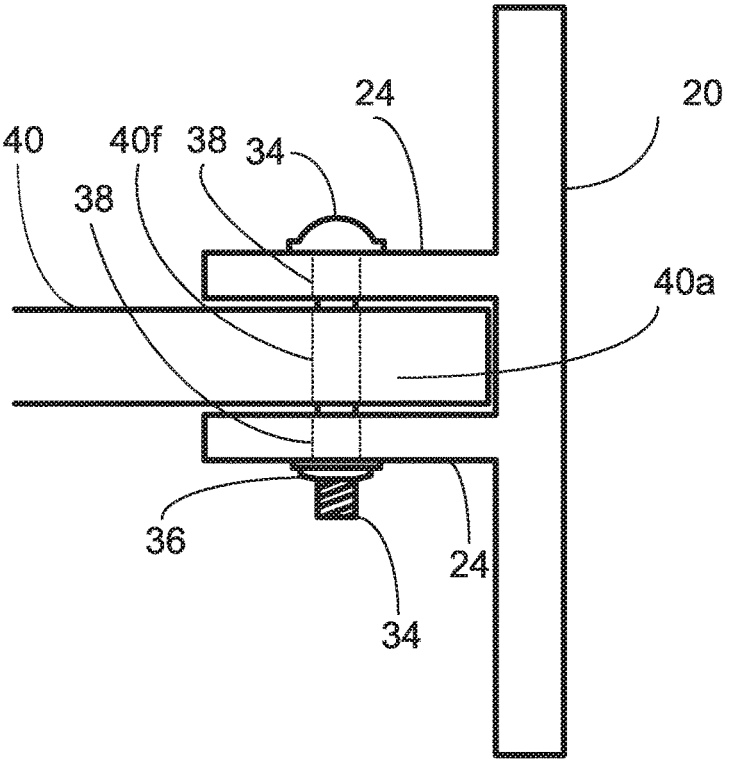
FIG. 16 is side view of an anchoring device illustrating one embodiment for pivotably connecting the cross member to the support base by inserting and fastening a bolt through a bore in the cross member and the support base.

FIG. 16 illustrates another embodiment for pivotably connecting the cross member 40 to the support base 20. In this embodiment, the laterally extending flange 24 of the support base 20 comprises two flanges, and there is a hole 38 through the two flanges 24 that is axially aligned with the hole or bore 40*f* in the end 40*a* of the cross member, the holes/bores 38, 40*f* for receiving a pin or bolt 34, which is held in place with a washer and nut 36.

Figure 17:
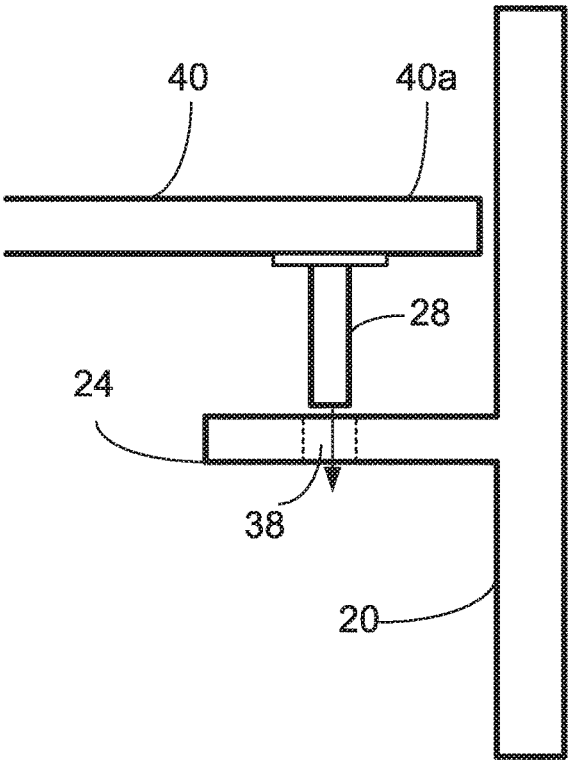
FIG. 17 is a side view of an anchoring device having a pin extending from the cross member for pivotably connecting the cross member to the support base.

FIG. 17 illustrates a further embodiment for pivotably connecting the cross member 40 to the support base 20. In this embodiment, the laterally extending flange 24 of the support base 20 has a hole 38 for receiving a pin 28 that extends vertically downwards from the end 40*a* of the cross member.

Other suitable attachment means may be used for connecting the cross member to the support bases, provided such attachment means allow for rotation about a vertical axis.

Figure 3B:
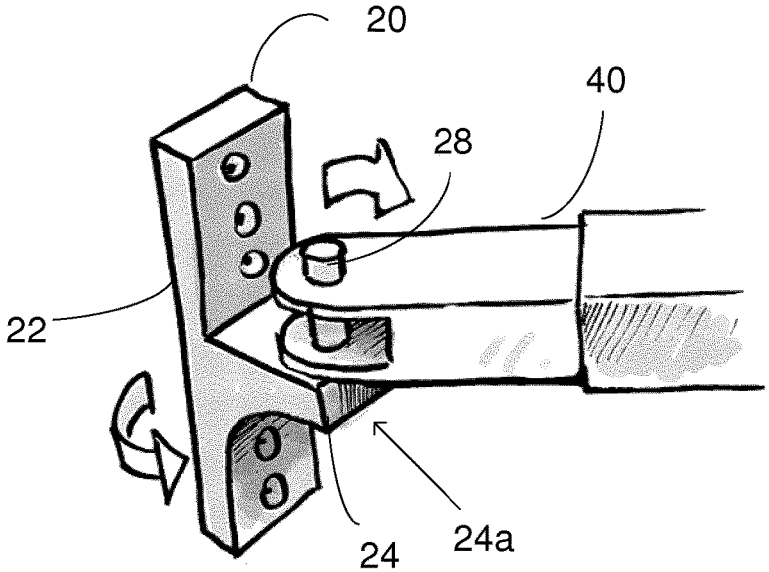
FIG. 3B is a top perspective view of one end of the anchoring device of FIG. 1 illustrating how the cross member can pivot with respect to the support base.
Figure 3C:
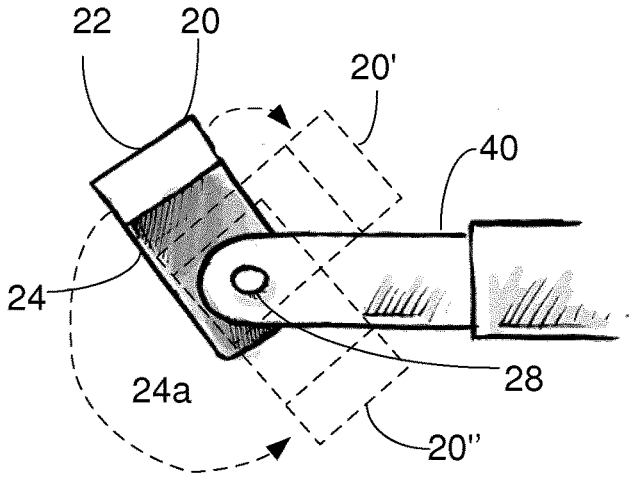
FIG. 3C is a top view of the end of the anchoring device of FIG. 3B illustrating how the support base can pivot with respect to the cross member.

The attachment means for pivotably connecting the cross member to the support base allows for rotation of the cross member end about a vertical axis, as shown by the arrows in FIGS. 3B and 3C, while minimizing or preventing rotation or movement about other axes (i.e. about longitudinal or lateral axes of the cross member). The cross member can freely rotate about the support base pin 28. In the embodiment shown in FIGS. 3A to 3C, the degree of rotation in either direction is limited by contact of the cross member with the support base body 22. As shown in FIG. 3C, the support base 20 rotates in either direction as shown by the arrows, until the body 22 of the support base contacts the cross member 40, preventing the support base from rotating any further past the position shown by the dotted lines of the support base 20' and 20". In this embodiment, the support base and cross member can effectively rotate approximately 270° with respect to each other, which allows for a large variety of configurations of the anchoring device.

Figure 3E:
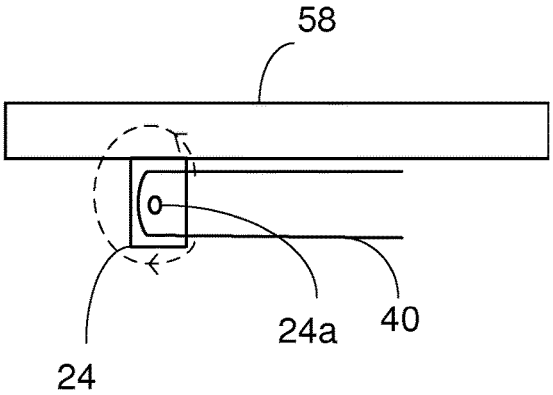
FIG. 3E is a top plan view of the anchoring device and wall frame of FIG. 3D.
Figure 3D:
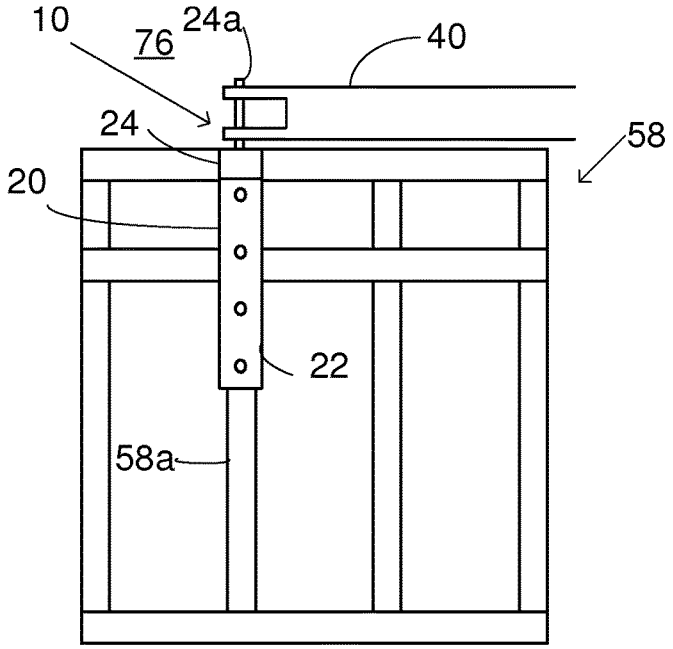
FIG. 3D is a front elevational view of an anchoring device wherein the cross member is pivotably connected near the top of the support base and the anchoring device is fastened near the top of a wall frame, allowing the cross member to pivot 360° about the support base.

In certain configurations and situations, such as shown in FIGS. 3D and 3E, if the support base and supporting surface (i.e. the wall or other surface the device is fastened to) do not prevent the cross member 40 from rotating beyond a certain angle, the support base and cross member 40 can freely rotate 360° with respect to each other. FIG. 3D is a front view of the anchoring device 10 fastened to a wall stud 58*a* of a wall frame 58, wherein there is an open space 76 above the wall frame. The laterally extending flange 24 of the support base is located near or at the top of the support base body 22, which allows the cross member 40 to rotate freely 360° about a vertical axis in either direction since the support base 20 nor the wall 60 are in the path of rotation. FIG. 3E is a top view of the configuration of FIG. 3D, wherein the dotted arrows show the rotation of the telescoping member with respect to the support body.

Materials

The anchoring device can be manufactured from a variety of suitable materials, for example lightweight aluminum. The anchoring device can also be molded from high strength materials, such as super-strength polypropylene, high density polythene, Kevlar™, and other materials that would be know to those skilled in the art.

Platform

As shown in FIG. 2, the cross member 40 of the anchoring device can support an end 50*a* of a plank 50 to create a platform. The other end of the plank can be supported by a second anchoring device, shown in FIGS. 10 to 15, or by another support such as a stairwell landing 70, shown in FIG. 8.

The plank may be adjustable in length in order to configure the plank to fit the dimensions of the space the platform is assembled in. FIG. 2 illustrates one embodiment of an adjustable plank, wherein a first member 52 slides telescopically within a second member 54. In another embodiment, one or more members of the plank may simply slide, not necessarily telescopically, with respect to one or more other members of the plank to adjust the length of the plank. Alternatively, instead of having an adjustable plank, one or more planks may be simply cut to the desired length as needed.

Plank Engagement

Figure 5B:
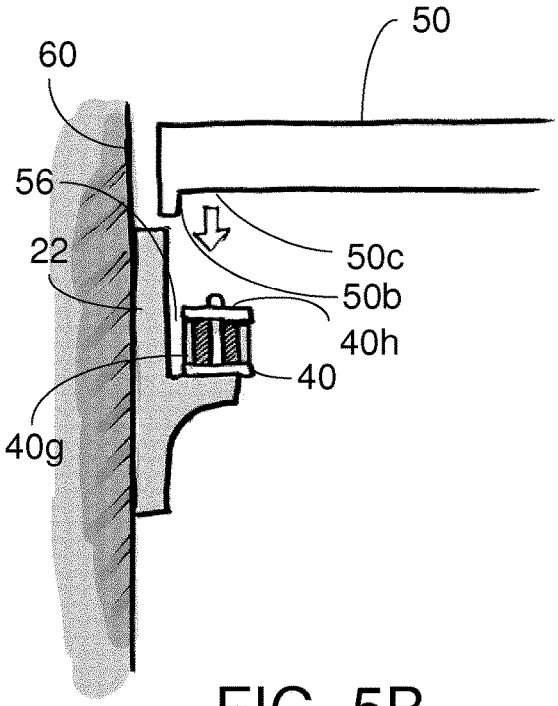
FIG. 5B is a side view of the anchoring device of FIG. 5A illustrating the plank with a lip being placed on the cross member to create a platform.

The plank is configured to operatively engage with the anchoring device, and preferably with the cross member part of the anchoring device. Referring to FIGS. 5A and 5B, the plank 50 may have a lip 50*b*, preferably a downwardly extending lip that extends along the end length of the plank, for engaging with the anchoring device. The lip 50*b* may be configured to fit within a space 56 between the support member body 22 and a rear surface 40*g* of the cross member. The bottom surface 50*c* of the plank adjacent the lip rests on an upper surface 40*h* of the cross member.

Figure 6A:
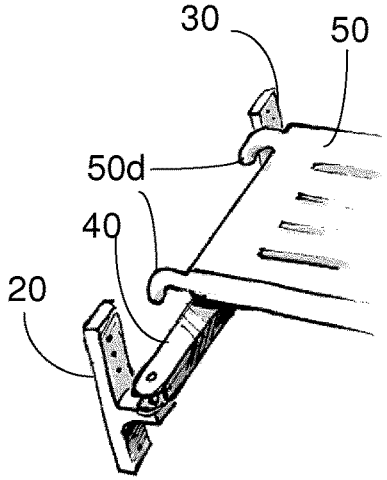
FIG. 6A is a top perspective view of the anchoring device of FIG. 1 illustrating a plank with hooks being hooked on the cross member to create a platform.
Figure 6B:
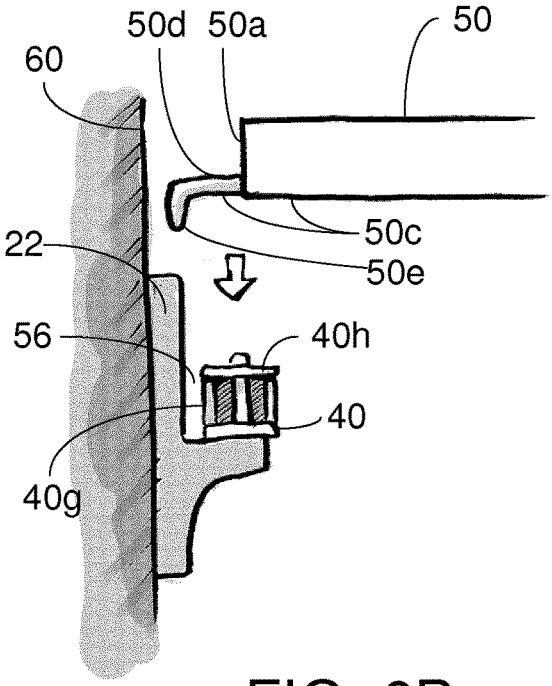
FIG. 6B is a side perspective view of the anchoring device of FIG. 6A illustrating the plank with hooks being hooked on the cross member to create a platform.

In another embodiment, shown in FIGS. 6A and 6B, the plank 50 has one or more hooks 50*d* extending from the plank end 50*a*. The distal end 50*e* of the hook is configured to fit within the space 56 between the support body 22 and the cross member rear surface 40*g*, and the bottom surface 50*c* of the hooks and/or the plank rests on the upper surface 40*h* of the cross member.

Alternatively, a basic flat plank or board, or plurality of planks or boards, can simply rest on the cross member, and/or be fastened to the cross member through the use of screws, nails, clamps or other fastening means. Alternative methods of configuring the plank to engage with the anchoring device would be apparent to one skilled in the art.

A rubber surface or other high-friction surface may be attached to the anchoring device, such as for example on the upper side of the crossbar where the plank is supported to create the platform. The rubber or high-friction surface can minimize movement between the crossbar and plank.

Platform Configurations

FIGS. 8 to 15 illustrate the versatility of the anchoring device for creating platforms in different spaces having various configurations and dimensions. The support bases of the anchoring devices can be fastened to flat or curved surfaces, and to surfaces that are at various angles to each other, including parallel surfaces, perpendicular surfaces, and any other irregularly angled surfaces.

Figure 8:
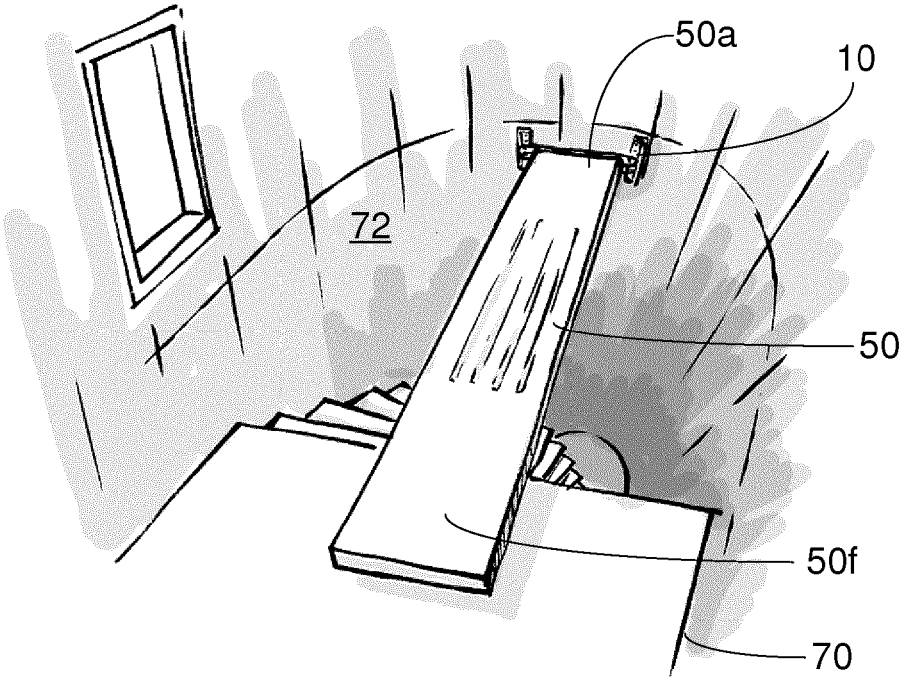
FIG. 8 is a top perspective view of a platform created in a spiral stairwell using the anchoring device to support one end of a plank, the other end of the plank supported by the stairwell landing.
Figure 9:
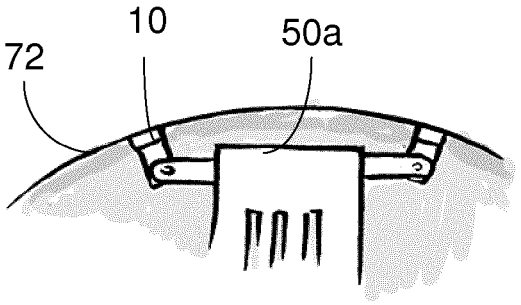
FIG. 9 is a partial top view the anchoring device mounted on a curved wall.

In FIG. 8, one anchoring device 10 is fastened to a curved wall 72 in a spiral staircase to support one end 50*a* of the plank 50, while the second end 50*f* of the plank is supported by the stairwell landing 70. FIG. 9 is a close up top view showing how the anchoring device can be fastened to the curved wall 72.

Figure 10:
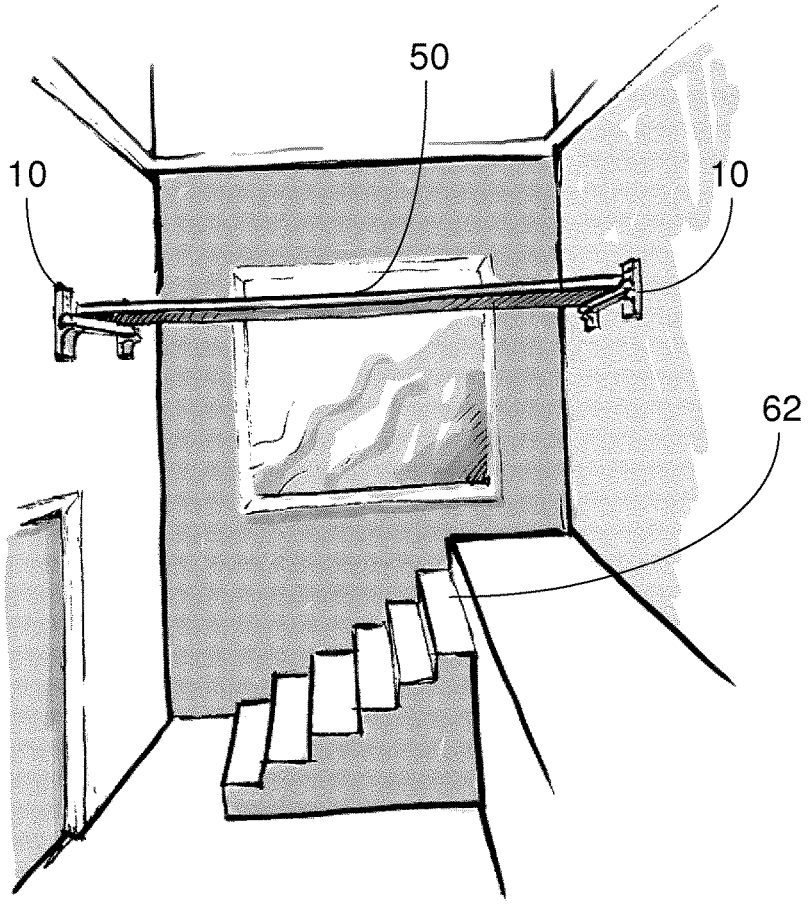
FIG. 10 is a side perspective view of a platform created above an open staircase using two anchoring devices mounted to opposing walls to support a plank.
Figure 11:
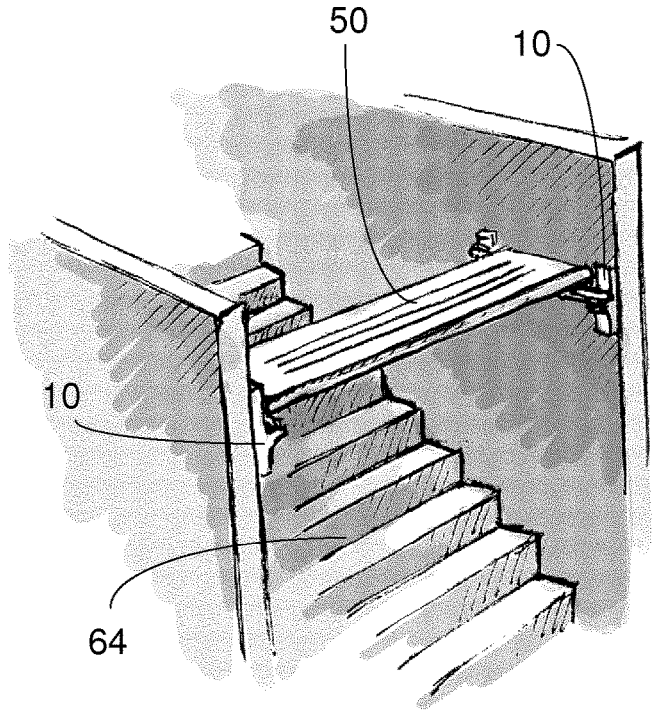
FIG. 11 is a top perspective view of a platform created above a walled staircase using two anchoring devices mounted on opposing walls to support a plank.

FIGS. 10 and 11 illustrates how a platform can be created above an open staircase 62 (FIG. 10) or an enclosed/walled-in staircase 64 (FIG. 11) using two anchoring devices 10 fastened to opposing parallel walls to support the plank 50.

Figure 12:
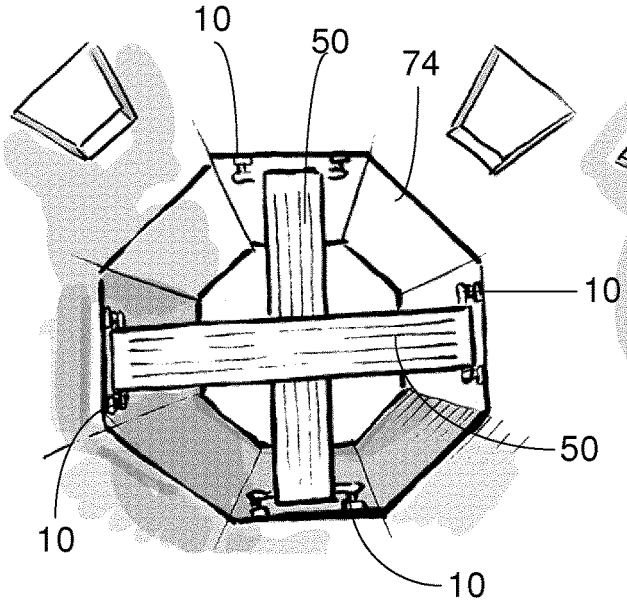
FIG. 12 is a top perspective view of two platforms created in an octagonal turret wherein for each platform, two anchoring devices are mounted on opposing flat walls to support a plank.
Figure 13:
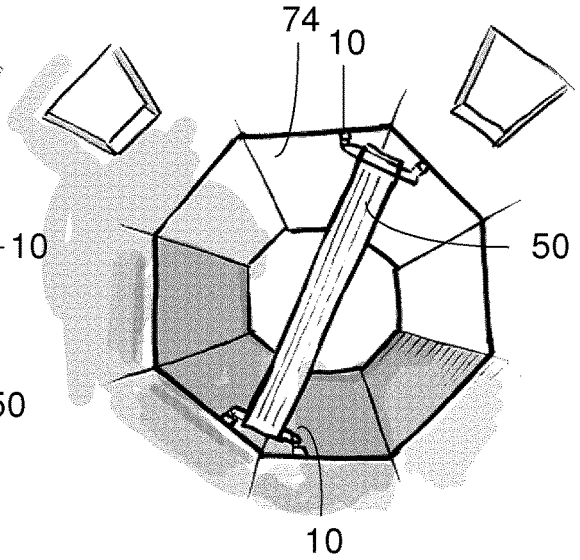
FIG. 13 is a top perspective view of a platform created in an octagonal turret wherein two anchoring devices are mounted at opposing wall corners to support a plank.
Figure 14:
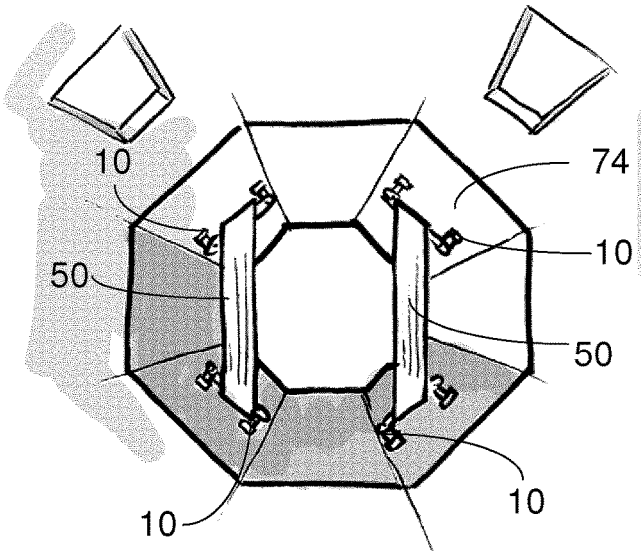
FIG. 14 is a top perspective view of two platforms created in an octagonal turret wherein for each platform, two anchoring devices are mounted on opposing angled walls to support a plank.

FIGS. 12 to 14 illustrate various ways to set up one or more platforms in a turret having octagonal walls 74 using anchoring devices 10 to support the plank 50. The anchoring devices can be mounted on flat parallel opposing walls (FIG. 12), to opposing wall corners (FIG. 13), or to opposing walls that are angled with respect to each other (FIG. 14).

Figure 15:
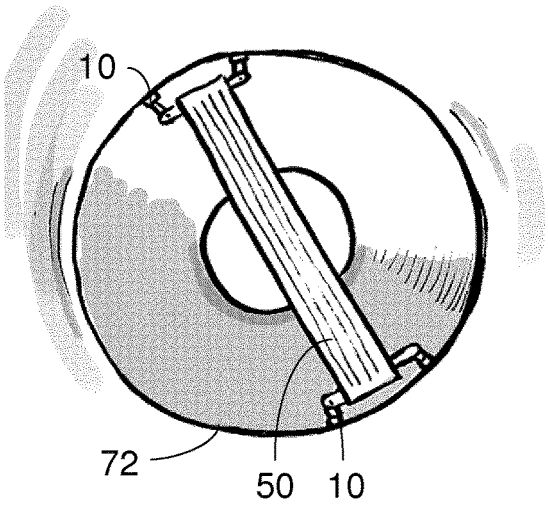
FIG. 15 is a top perspective view of a platform created in a round turret wherein two anchoring devices are mounted on opposing curved walls to support a plank.

FIG. 15 illustrates a platform set up in a round turret having a curved wall 72 to which two anchoring devices 10 attach to support a plank 50.

Figure 19:
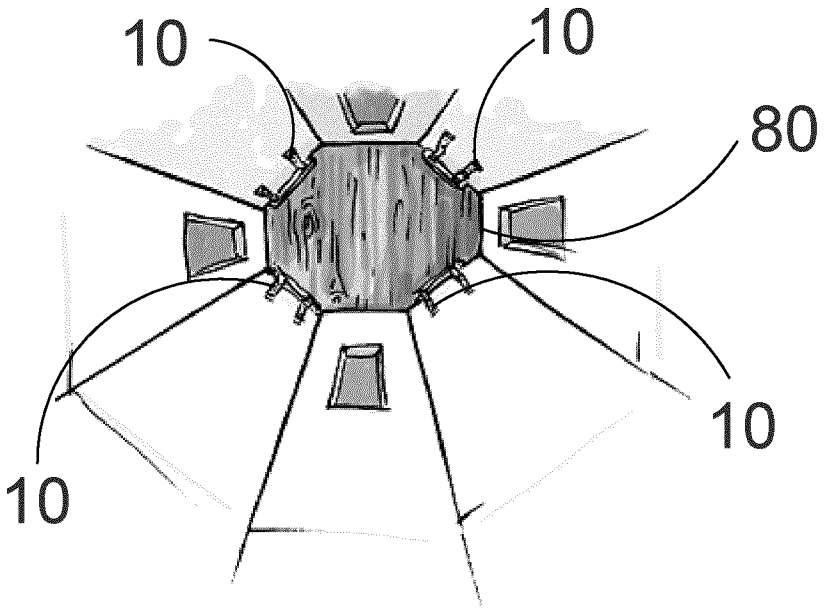
FIG. 19 is a bottom perspective view of an octagonal shaped platform created in an octagonal turret wherein four anchoring devices are mounted on the turret walls to support a platform.

The plank or board used to create a platform is not limited to rectangular shaped boards. For example, FIG. 19 illustrates an octagonal turret having four anchoring devices 10 attached on four walls for supporting an octagonal shaped platform 80.

Method for Installing the Anchoring Device and Creating a Platform

To install the anchoring device, the first support base is fastened to a first surface, and the second support base is fastened to a second surface nearby the first surface. A first end of the cross member is pivotably connected to the first support base, and a second end of the cross member is pivotably connected to the second support base. The length of the cross member is adjusted as required to fit between the first and second surfaces. These steps do not have to be done in the order given. For example, the cross member can be connected between the first and/or second support base(s) before the support bases are fastened to the support surfaces.

Preferably, the first and second surfaces are in the same horizontal plane such that the first and second support base are level with each other.

After the anchoring device is installed, a first end of a plank is engaged with the anchoring device in order to support the plank. The second end of the plank can be engaged with a second anchoring device that is installed in the same manner as the first anchoring device, or it can be supported by another surface.

Alternative Uses

The anchoring device of the invention may be used for other purposes besides creating a platform, such as supporting or hanging various materials, tools, equipment, decorations, shelving, racks, and more. For example, multiple anchoring devices can be spaced apart vertically on a surface such as a wall or inside a chimney to create a ladder without side rails. In another example, the anchoring device can be used to suspend lighting across a room, which is particularly useful in rooms with high ceilings where it is desirable to have lights lower than the ceiling (i.e. in the space between the ceiling and the floor).

Although the present invention has been described and illustrated with respect to preferred embodiments and preferred uses thereof, it is not to be so limited since modifications and changes can be made therein which are within the full, intended scope of the invention as understood by those skilled in the art.

The invention claimed is:

1. An anchoring device for use in assembling a load-bearing platform to be supported by one or more substantially vertical walls, the anchoring device comprising:

a cross member adjustable in length and having a first and a second end, each end having a substantially vertical bore extending at least partially through the cross member ends; and a first and a second support base, each support base having:

a wall attachment surface;

a laterally extending flange that forms a substantially planar flange surface perpendicular to a plane of the wall attachment surface for supporting one of the cross member ends; and a substantially vertical pin extending upwardly from the substantially planar flange surface for pivotable engagement with one of the substantially vertical bores of the cross member, the substantially vertical pin having a free top end for reversible engagement with the cross member through lowering and lifting the cross member in a substantially vertical direction;

wherein the cross member has a substantially planar load bearing upper surface for supporting the load-bearing platform on top of the cross member; and wherein each end of the cross member can independently pivot with respect to the first and second support bases about a vertical axis for allowing the anchoring device to attach to two points on the one or more substantially vertical walls that may be at different angles with respect to the vertical axis.

2. The anchoring device as in claim 1, wherein the cross member comprises at least two sections arranged in sliding telescoping relationship to selectively vary a length of the cross member.

3. The anchoring device as in claim 2, wherein the at least two sections of the cross member do not rotate and do not pivot with respect to each other.

4. The anchoring device as in claim 2, wherein each section of the cross member includes the substantially planar load bearing upper surface of the cross member.

5. The anchoring device as in claim 1, wherein each of the first and second support bases includes a plurality of holes for receiving fastening devices for fastening the first and second support bases to the one or more substantially vertical walls.

6. The anchoring device as in claim 1, wherein each of the first and second support bases includes a pin extending from the wall attachment surface for tacking the support base to the one or more substantially vertical walls without the use of tools to hold the support base in place on the substantially vertical wall while the-support base is being fastened to the substantially vertical wall.

7. The anchoring device as in claim 1, further comprising a plank for forming the load-bearing platform, the plank having a first plank end that is supported on the substantially planar load bearing upper surface of the cross member.

8. The anchoring device as in claim 1, wherein the substantially vertical pin is integral with the laterally extending flange of the support base.

9. The anchoring device as in claim 1, wherein the cross member comprises a first member and a second member, the first member including the cross member first end having the substantially vertical bore for pivotable engagement with the substantially vertical pin of the first support base, the second member including the cross member second end having the substantially vertical bore for pivotable engagement with the substantially vertical pin of the second support base, and wherein a second end of the first member and a second end of the second member are in sliding engagement with each other to selectively vary a length of the cross member.

10. The anchoring device as in claim 1, wherein the first and second support bases do not rely on compression from the cross member to engage with the one or more substantially vertical walls.

11. An anchoring device for use in assembling a load-bearing platform to be supported by one or more substantially vertical walls, the anchoring device comprising:

a substantially linear cross member adjustable in length and having a first and a second end, each end having a substantially vertical pin extending downwardly from the cross member ends, wherein the cross member comprises at least two sections arranged in sliding telescoping relationship to selectively vary the length of the cross member; and a first and a second support base, each support base having:

a wall attachment surface;

a laterally extending flange that forms a substantially planar flange surface perpendicular to a plane of the wall attachment surface for supporting one of the cross member ends; and a substantially vertical bore extending at least partially through the substantially planar flange surface for pivotable engagement with one of the substantially vertical pins of the cross member, the substantially vertical pins having free bottom ends for reversible engagement with the first and second support bases through lowering and lifting the cross member in a substantially vertical direction;

wherein the cross member has a substantially planar load bearing upper surface for supporting the load-bearing platform on top of the cross member; and wherein each end of the cross member can independently pivot with respect to the first and second support bases about a vertical axis for allowing the anchoring device to attach to two points on the one or more substantially vertical walls that may be at different angles with respect to the vertical axis.

12. The anchoring device as in claim 11, wherein each of the first and second support bases includes a plurality of holes for receiving fastening devices for fastening the first and second support bases to the one or more substantially vertical walls.

13. The anchoring device as in claim 11, wherein each of the first and second support bases includes a pin extending from the wall attachment surface for tacking the support base to the one or more substantially vertical walls without the use of tools to hold the support base in place on the substantially vertical wall while the support base is being fastened to the substantially vertical wall.

14. The anchoring device as in claim 11, further comprising a plank for forming the load-bearing platform, the plank having a first plank end that is supported on the substantially planar load bearing upper surface of the cross member.

15. The anchoring device as in claim 11, wherein the substantially vertical pin is integral with the cross member.

16. The anchoring device as in claim 11, wherein each section of the cross member includes the substantially planar load bearing upper surface of the cross member.

17. The anchoring device as in claim 11, wherein the cross member comprises a first member and a second member, the first member including the cross member first end having the substantially vertical pin for pivotable engagement with the substantially vertical bore of the first support base, the second member including the cross member second end having the substantially vertical pin for pivotable engagement with the substantially vertical bore of the second support base, and wherein a second end of the first member and a second end of the second member are in sliding engagement with each other to selectively vary a length of the cross member.

18. The anchoring device as in claim 11, wherein the load-bearing platform is directly supported on top of the cross member.

* * * * *